United States Patent [19]

Tanaka

[11] Patent Number: 5,031,847

[45] Date of Patent: Jul. 16, 1991

[54] WIRE-SUPPLYING DEVICE FOR MANUFACTURING WIRE HARNESSES INVENTION

[75] Inventor: Hiromi Tanaka, Machida, Japan

[73] Assignee: AMP Incorporated, Harrisburg, Pa.

[21] Appl. No.: 505,734

[22] Filed: Apr. 6, 1990

[30] Foreign Application Priority Data

Aug. 4, 1989 [JP] Japan ..... 1-41043

[51] Int. Cl.[5] ..... B65H 49/00; B65H 51/04; B65H 63/036

[52] U.S. Cl. ..... 242/54 R; 242/37 R; 242/45; 226/11; 226/119

[58] Field of Search ..... 242/54 R, 45, 37 R, 242/49, 57, 157 R; 226/118, 119, 11, 43, 44

[56] References Cited

U.S. PATENT DOCUMENTS

| | | | |
|---|---|---|---|
| 3,038,674 | 6/1962 | Wahl | 242/25 |
| 3,049,308 | 8/1962 | Lang | 226/43 X |
| 3,151,819 | 10/1964 | Hodgdon | 242/54 R |
| 3,361,375 | 1/1968 | Klink et al. | 242/45 X |
| 3,583,651 | 6/1971 | Schulze | 242/54 R |
| 3,638,873 | 2/1972 | Cole | 242/45 |
| 3,852,141 | 12/1974 | Cross | 242/37 R X |
| 3,966,132 | 6/1976 | Gelin et al. | 242/37 R X |
| 4,030,527 | 6/1977 | Roch | 140/92.1 |
| 4,975,723 | 12/1990 | Hammerquist et al. | 226/119 X |

FOREIGN PATENT DOCUMENTS 1190811 4/1967 United Kingdom .

*Primary Examiner*—John M. Jillions

*Attorney, Agent, or Firm*—Allan B. Osborne; Adrian J. LaRue

[57] ABSTRACT

A wire-supplying device comprises wire-supplying drums (15) for supplying a plurality of wires (16), a wire-feeding roller (21) for feeding the plurality of wires (16), a weight roller (28) mounted on a sliding member (27) supported on rods (26) for vertical movement therealong, a stopping member (30) on the sliding member (27) for engagement with the rods (26) to stop vertical movement of the sliding member (27), and actuation means for moving and maintaining the stopping member (30) against the rods (26).

10 Claims, 3 Drawing Sheets

WIRE-SUPPLYING DEVICE FOR MANUFACTURING WIRE HARNESSES INVENTION

FIELD OF THE INVENTION

This invention relates to a wire-supplying device for manufacturing wire harnesses, more specifically to such device capable of stopping, if necessary, the vertical movement of a weight roller that moves vertically to apply tension to a plurality of wires in the step of supplying such wires constituting a part of electrical wire harnesses to a wire harness-making machine.

BACKGROUND OF THE INVENTION

Electrical wire harnesses have been practically used as circuit components for a certain type of electrical machines and equipment, such wire harnesses having an electrical connector at one or both ends of a plurality of aligned wires. The wire harnesses are cut by the machine at a desired length of the plurality of aligned wires and assembled by terminating to an electrical connector at one end or electrical connectors at both ends of the wires. In this case, wires are continuously fed from wire supply units coupled to the harness-making machine.

Typically, the wire supply units comprise a plurality of wire-supplying drums, a wire-feeding roller, and a weight roller vertically slidably and supported to apply desired tension to the wires.

In assembling wire harnesses by feeding a plurality of aligned wires to the harness-making machine from the wire supply units, wire discontinuities are encountered due to exhausting all the wires on the wire-supplying drums or breaking of certain wires. When this happens, the wire harness-making machine and the wire supply units are stopped to take necessary measures so that the wires can be fed continuously before restarting their operations.

It is conventional practice to cut the non-broken wires so that the front ends of the non-broken wires are in alignment with the front ends of the broken and subsequent wires, including the wires supplied from the newly-added, fully-wound, wire-supplying drum. The group of wires with aligned front ends are then manually placed at the predetermined location in the wire harness-making machine. However, such conventional practice wastes wire. Alternately, only the broken portion of a broken wire is removed from the subsequent wire and the subsequent wire is carefully measured to be identical in length to the other wires before returning to the predetermined position in the harness-making machine. Moreover, such approach requires complicated steps to carefully pull the wire and is inefficient. The reason of carefully pulling the wire is to pull such wire through the weight roller without moving it so that the tension to the non-broken wires by the weight roller is not released while in turn not disturbing the proper alignment of the wires and consuming more time to correct the problem.

SUMMARY OF THE INVENTION

In order to achieve the above object, the present invention is a wire supply device for making wire harnesses comprising a plurality of wire-supplying drums, a wire-feeding roller, and a weight roller vertically slidably supported to provide required tension to the plurality of wires. The weight roller is supported onto a sliding member provided with a stopper member which may be brought in engagement with a stationary part of the machine by actuation means to actuate the stopper member to stop vertical sliding of the sliding member.

In the preferred embodiment, the actuation means is an air cylinder having a sliding lever to which the stopper member is mounted.

In the present device as constructed above, the wire-feeding roller is driven to feed the plurality of wires from the wire-supplying drums to the wire harness-making machine The weight roller is located in the feeding path of the wires to provide appropriate tension thereto. When one or more of the wires in the wire-supplying drums are exhausted or in some other instances are broken, the vertical movement of the sliding member to support the weight roller is stopped by actuating the actuation means for the stopper member.

BRIEF DESCRIPTION OF THE DRAWINGS

An embodiment of the present device will be described in detail by way of example with reference to the accompanying drawings.

DETAILED DESCRIPTION OF THE INVENTION

Figure 1:
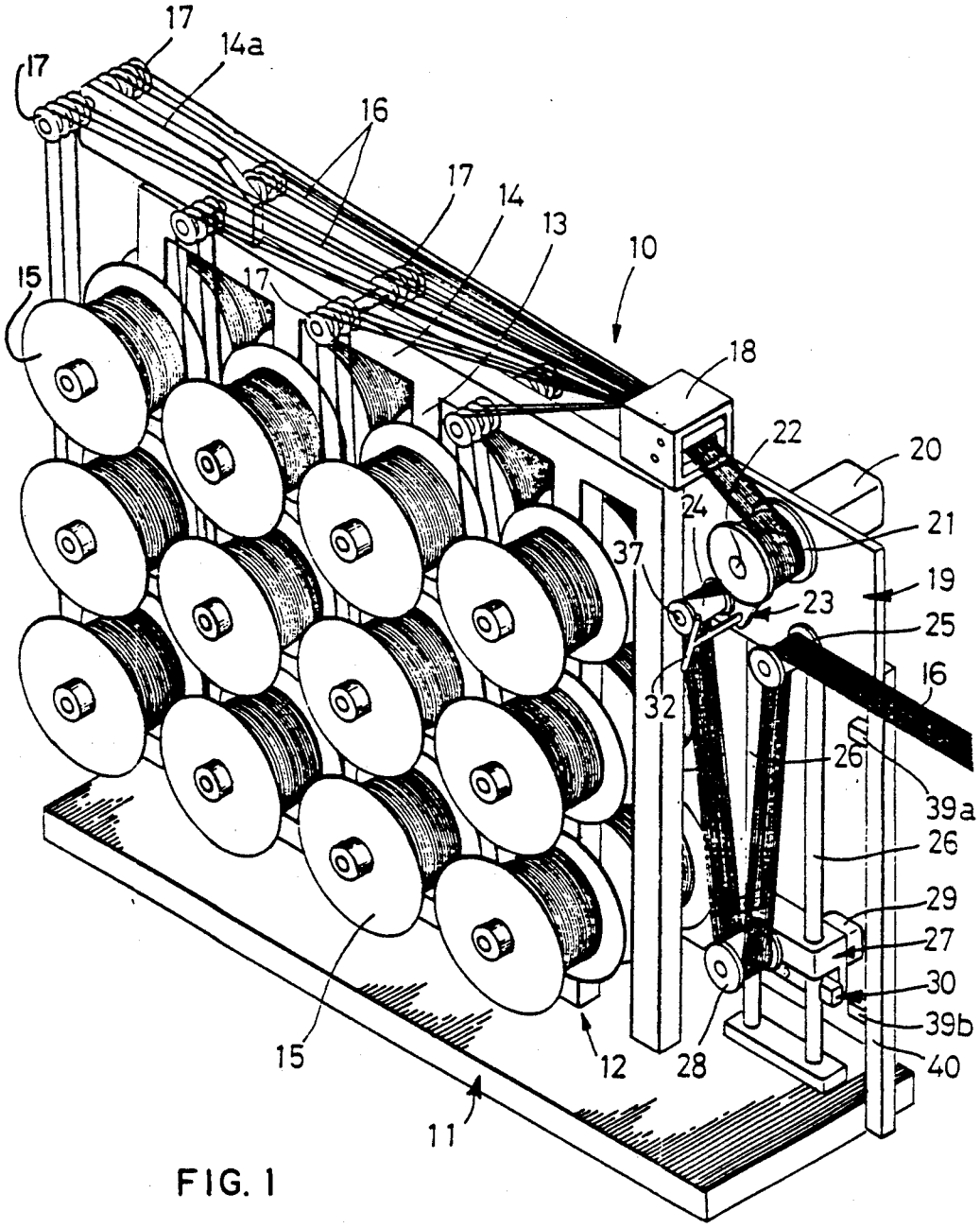
FIG. 1 is a perspective view of the entire wire supply unit according to an embodiment of the present invention.
Figure 2:
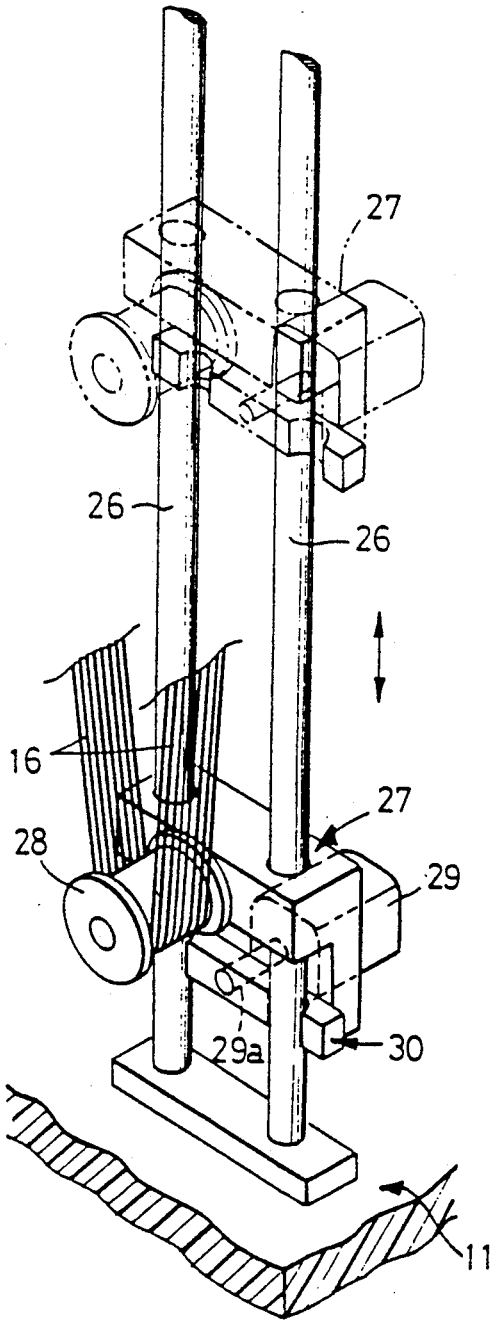
FIG. 2 is a perspective view of the weight roller, stopper member and actuation means of the present invention.
Figure 3A:
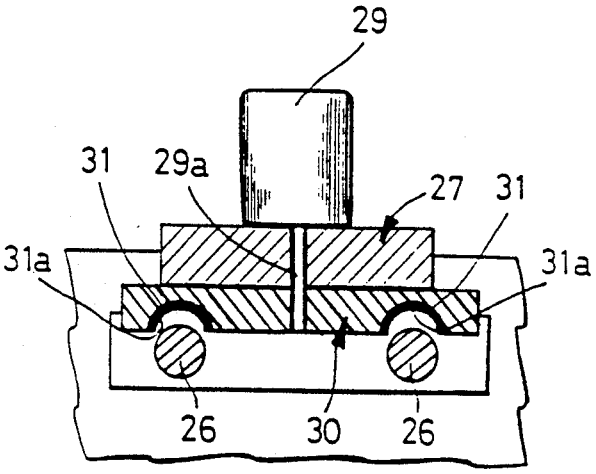
FIGS. 3A and 3B are cross-sectional views of the stopper member in non-operated and operated conditions, respectively.
Figure 3B:
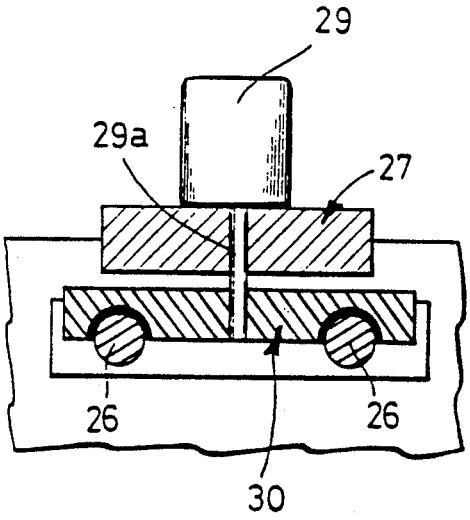

Illustrated in FIG. 1 is a unit 10 containing a base plate 11 and a support frame 12 extending from the base plate 11. The support frame 12 comprises a plurality of horizontally-spaced vertical members 13 and a horizontal bar 14 located at the tops of the vertical members 13. Supported on both sides of each vertical member 13 are a plurality of wire-supplying drums 15 at a constant spacing. Each drum 15 will rotate when the wire 16 wound onto the drum 15 is pulled but is provided with a known braking mechanism (not shown) to prevent rotation until the wire is pulled.

Provided at one upper end of the support frame 12 is a wire-discontinuity detection means 18 which aligns the wires 16 fed by way of wire guide rollers 17 located at spaced locations on the horizontal bar 14 and its extension member 14*a*. Also, the wire-discontinuity detection means 18 detects and sends a detection signal to a motor to be mentioned hereinafter when the detection means 18 detects any missing wire 16, such as by exhaustion of the wire 16 from the wire-supplying drums 15 or a broken wire.

Supported on a support member 19 extending from the support frame 12 near the detection means 18 are an electric motor 20 and a wire-feeding roller 21 driven by the motor 20. The feeding roller 21 is provided with wire alignment grooves (not shown) on the outer periphery. The motor 20 stops driving on receiving a signal from the detection means 18. When the motor 20 stops driving, the wire harness-making machine (not shown) also stops operation in synchronism with the motor 20. A support arm 23 extends from the axis 22 of the feeding roller 21 on which the support arm 23 is pivotally mounted. A wire tension-adjusting roller 24 is supported at the free end of the support arm 23. Separate from the tension-adjusting roller 24, a wire-guiding roller 25 is mounted on the support member 19.

In FIGS. 1, 2, 3A and 3B, a pair of parallel rods 26 are provided between the base plate 11 and the support member 19 for supporting a sliding member 27 which is slidable in a vertical direction. Mounted to the sliding member 27 is a weight roller 28 to engage with the wires 16 forming them in a V-configuration to provide proper tension onto the wires 16. Also provided on the outer circumference of the weight roller 28 are wire-alignment grooves (not shown). An air cylinder 29 is installed on one side of the sliding member 27. The air cylinder 29 may operate independent of the motor 20 but may be operated in synchronism with stopping of the motor 20, for example, when the detection means 18 detects discontinuity of one of the wires 16 and sends a signal to stop the motor 20. A sliding rod 29*a* as part of the piston of the air cylinder 29 extends through the sliding member 27 and a stopper member 30 is supported at the front end of the sliding rod 29*a*. The stopper member 30 has concave recesses 31 on the surfaces of which are provided with anti-slipping members 31*a* to contact with surfaces of the rods 26. The anti-slipping members 31*a* are preferably made of sponge-like material resembling felt with a high friction coefficient.

Placed at upper and lower positions on the inner surface of a support 40, which extends between the base plate 11 and the support member 19, are sensors 39*a*, 39*b* to send a detection signal to the motor 20 when the sliding member 27 reaches its upper and lower positions. More in detail, in the wire harness-making machine, the group of wires 16 are rapidly pulled toward the machine by a desired length to measure the length of the wires 16 needed for each wire harness. In this case, the wires will raise the sliding member 27 by way of the weight roller 28. When the sliding member 27 reaches the predetermined upper reference position, the upper sensor 39*a* detects this and sends a signal to the motor 20 which is then driven to pull and feed the wires 16 from the wire-supplying drums 15. Then, the wires 16 drop downwardly due to the action of the weight roller 28 until they are detected by the lower sensor 39*b* when the sliding member 27 reaches the predetermined lower reference position. The lower sensor 39*b* detects this condition and sends a detection signal to the motor 20 to stop driving the feed roller 21. It is, of course, possible to design the motor 20 so that the motor 20 is normally running at a constant speed and increases its speed when the upper reference position is reached.

Figure 4A:
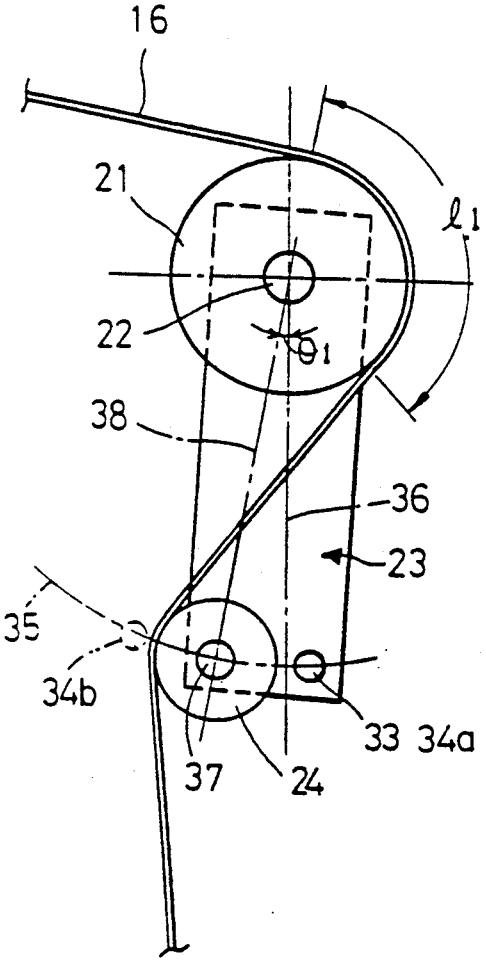
FIGS. 4A and 4B are side views to show the angle of the wire tension-adjusting roller with respect to the wire-feeding roller with smaller and larger angle conditions, respectively.
Figure 4B:
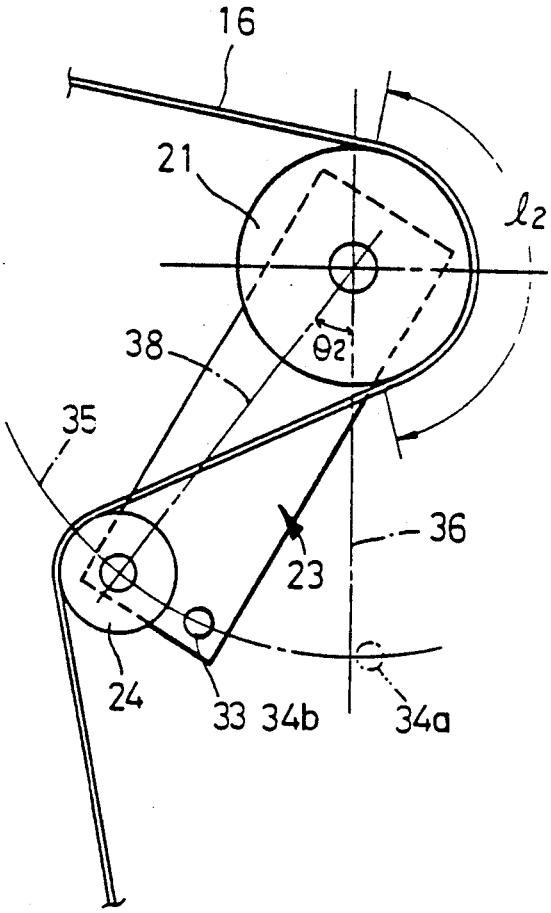

As illustrated in FIGS. 4A and 4B, the support arm 23 having the tension-adjusting roller 24 is provided with a latching opening 33 at the free end thereof. Also provided in the support member 19 (see FIG. 1) along an arcuate path 35 including the latching opening 33 are spaced latching openings 34*a*, 34 *b*. When the support arm 23 is in its vertical position, as shown in FIG. 4A, the tension-adjusting roller 24 is supported on a vertical line 38 passing through the center of the shaft 22 of roller 21 by the angle $\theta 1$ with respect to a vertical line 36 also passing through the center of the shaft 22. The support arm 23 is mounted by inserting a latching lever 32 (see FIG. 1) into the latching opening 34*a* of the support member 19 through the latching opening 33 of support arm 23 whereby the wires 16 are wound around the feeding roller 21 by the length l1. However, when the latching lever 32 is removed and the support arm 23 is moved to the left, for example, by the angle $\theta 2$ as shown in FIG. 4B, the latching lever 32 is inserted into the latching opening 33 in the support arm 23 and the latching opening 34*b* in the support member 19, the wires 16 are wound around the feeding roller 21 by the length 2 that is longer than the above length thereby increasing tension on the wires 16.

According to the present invention, the provision of a stopper member on the sliding member supporting the weight roller will enable the operator to troubleshoot a wire discontinuity as a result of the stopping of the vertical sliding of the sliding member by instantly pressing the stopper member to a stationary member of the machine by actuation means. If one of the wires is broken, only the broken wire is pulled to the predetermined position of the wire harness-making machine while the wire passes through the weight roller so that all of the wires have the aligned ends at the predetermined position at the wire harness-making machine. It is to be noted that pulling the broken wire through the weight roller will not release the tension or disturb the alignment of the non-broken wires because of the weight roller which is now stationary. This will provide quicker, economical and efficient troubleshooting in a case of wire discontinuity or breakage and preclude the non-broken wires from becoming entangled because of the tension being applied to them by the weight roller.

What is claimed is:

1. In a wire-supplying device for making wire harnesses including a plurality of wire-supplying drums for supplying a plurality of wires, a wire-feeding roller for feeding the plurality of wires, and a weight roller on a sliding member supported slidably in a vertical direction to provide a desired tension to said plurality of wires, characterized in that:

said sliding member is provided with a stopping member to be engaged with a stationary member of said device by actuation means, thereby stopping the vertical sliding of said sliding member.

2. The device of claim 1, characterized in that said actuation means is an air cylinder having a sliding rod on which said stopping member is supported.

3. The device of claim 1, characterized in that detection means detects the discontinuity of one of the wires and causes the actuation means to be actuated thereby stopping the vertical sliding of said sliding member.

4. The device of claim 1, characterized in that sensing means senses upper and lower positions of said sliding member to interrupt operation of the wire-feeding roller.

5. The device of claim 1, characterized in that a tension-adjusting roller is pivotally mounted adjacent said wire-feeding roller.

6. A wire-supplying device for supplying electrical wires for making electrical harnesses, comprising:

wire-supplying means for supplying a plurality of electrical wires;

wire-feeding means for feeding the electrical wires;

wire-guiding means for guiding the electrical wires from the wire-feeding means to a wire harness-making machine;

movable sliding means having weight-roller means thereon engaging the wires between said wire-feeding means and said wire-guiding means for applying tension to the wires;

stopper means for stopping movement of said movable sliding means; and actuation means for actuation of said stopper means to stop movement of said movable sliding means when discontinuity of at least one of the wires occurs.

7. A wire-supplying device as claimed in claim 6, wherein detection means is located adjacent said wire-feeding means for detecting discontinuity of the wires and causing said actuation means to be actuated.

8. A wire-supplying device as claimed in claim 6, wherein sensing means senses movement of said sliding means between spaced locations causing said wire-feeding means to be interrupted.

9. A wire-supplying device as claimed in claim 6, wherein tension-roller means is pivotally mounted adjacent said wire-feeding means.

10. A wire-supplying device as claimed in claim 6, wherein rod means have said movable sliding means mounted thereon, said stopper means and said actuation means are mounted on said sliding means and said stopper means engages said rod means to stop movement of said movable sliding means when actuated by said actuation means.

* * * * *